US007712340B2

(12) United States Patent
Chang

(10) Patent No.: US 7,712,340 B2
(45) Date of Patent: May 11, 2010

(54) LOCK STRUCTURE

(76) Inventor: Wen-Kwei Chang, No. 30, Lane 208, Hesing Rd., Changjhih Township, Pingtung County (TW)

( * ) Notice: Subject to any disclaimer, the term of this patent is extended or adjusted under 35 U.S.C. 154(b) by 0 days.

(21) Appl. No.: 12/149,286

(22) Filed: Apr. 30, 2008

(65) Prior Publication Data

US 2009/0272160 A1 Nov. 5, 2009

(51) Int. Cl.
*E05B 67/02* (2006.01)
*E05B 67/24* (2006.01)

(52) U.S. Cl. ..... 70/38 A; 70/52; 70/417

(58) Field of Classification Search ..... 70/38 A, 70/39, 52, 417, 51, 54–56, DIG. 43, DIG. 56
See application file for complete search history.

(56) References Cited

U.S. PATENT DOCUMENTS 1,842,559 A * 1/1932 Murphy ..... 70/39
1,876,893 A * 9/1932 Fitz Gerald ..... 70/38 B
2,259,271 A * 10/1941 Seay, Jr. ..... 70/38 A
2,379,438 A * 7/1945 Hines et al. ..... 70/38 A
2,471,291 A * 5/1949 Soref et al. ..... 70/39
2,678,554 A * 5/1954 Palmer ..... 70/38 A
3,979,931 A * 9/1976 Man ..... 70/38 A
4,098,100 A * 7/1978 Wah ..... 70/38 A
4,180,996 A * 1/1980 Lebrecht ..... 70/52
4,422,314 A * 12/1983 Cooper ..... 70/242
4,464,915 A * 8/1984 Moshe et al. ..... 70/52
4,551,997 A * 11/1985 Huang ..... 70/38 A
4,838,051 A * 6/1989 Yang ..... 70/38 A
4,949,564 A * 8/1990 Barzilai ..... 70/417
5,230,231 A * 7/1993 Liou ..... 70/38 A
5,311,757 A * 5/1994 Spahn ..... 70/408
5,802,896 A * 9/1998 Tsai ..... 70/417
6,769,277 B1 * 8/2004 Chang ..... 70/52
6,810,698 B2 * 11/2004 Weinraub ..... 70/38 A
6,898,918 B2 * 5/2005 Eshraghi ..... 52/787.1
7,380,425 B2 * 6/2008 Elliott et al. ..... 70/56
7,490,497 B2 * 2/2009 Adcock ..... 70/38 A
2005/0235709 A1 * 10/2005 Meckbach ..... 70/38 A
2007/0234766 A1 * 10/2007 Rohde et al. ..... 70/52

* cited by examiner

*Primary Examiner*—Lloyd A Gall
(74) *Attorney, Agent, or Firm*—Rosenberg, Klein & Lee

(57) ABSTRACT

A lock includes a body, a key-operated core in the body, two spring-biased plates slideable on a recessed portion of the body, and a locking crutch to be fastened to the body with the spring-biased plates. The body has crutch embedding holes on two sides of the core; the core has a plate part, and force is applied to the spring-biased plates through the plate part when the core is turned. The locking crutch has a groove on each of two ends to engage a corresponding plate. The plates are biased to engage the locking crutch when the core is in the locking position; and, the plates are forced to disengage from the locking crutch by turning the lock core to the unlocking position. Saw-resistant pins are inserted in receiving holes formed on a periphery of the lock body to protect the lock against a saw.

10 Claims, 6 Drawing Sheets

LOCK STRUCTURE

BACKGROUND OF THE INVENTION

1. Field of the invention

The present invention relates to an improvement on a lock structure, more particularly one, which includes a lock body, and a locking crutch to cooperate with the lock body to lock an object; the lock body is equipped with two movable engaging plates, and the locking crutch has two grooves to receive respective ones of the movable engaging plates so that the lock can be firm in the locking configuration.

2. Brief Description of the Prior Art

A variety of locks are available for helping to prevent thievery, e.g. door locks, combination locks, and cable locks, which are mainly used for locking bicycles and motorcycles. And, the industry have recently developed electromagnetic locks, chip locks, and voice-controlled locks, which are more advanced than the above-mentioned conventional locks, and can't be easily opened by unauthorized persons. Moreover, stronger locks are also available, which are made of saw-resistant materials so as not to be damaged with saws.

A currently existing saw-resistant lock is available, which includes a lock body consisting of several metallic plate parts. The plate parts have already undergone heat treatment to increase their strength, and are positioned on above another. Therefore, it is relatively difficult for thieves to damage the lock with a saw.

However, it takes relatively much cost, labor and time to manufacture the saw-resistant lock because all of the metallic plate parts have to be subjected to heat treatment, and then stacked and fastened together by means of rivets.

To overcome the above-mentioned problems, the inventor of the present invention developed an improvement on a saw-resistant lock, which has been filed for U.S. patent application with application Ser. No. 11/979,652. The saw-resistant lock includes a lock body, a lock core held in a core holding hole of the lock body. The lock body has several pin holes on a periphery portion thereof, and saw-resistant pins are inserted in the pin holes of the lock body respectively; the saw-resistant pins have already undergone heat treatment to have high strength. Therefore, the present lock has a lower manufacturing cost, and is easier to assembly than the above-mentioned saw-resistant stacked-plate lock.

However, besides having saw-resisting capability, a lock should be very firm in the locking configuration and smoothly operable without the possibility of its locking crutch being interfered with when moving relative to the lock body. Therefore, it is a main object of the present invention to provide an improvement on a lock, which has a good saw-resisting capability, and is smoothly operable, and relatively easy to assemble as compared with the above-mentioned saw-resistant stacked-plate lock.

SUMMARY OF THE INVENTION

A lock in accordance with an embodiment of the present invention includes a lock body, a key-operated lock core in a middle hole of the lock body, two spring-biased movable plates slideable on a recessed portion of the lock body, and a locking crutch capable of being fastened to the lock body with the spring-biased movable plates. The lock body has crutch embedding holes on two sides of the middle hole. The lock core has a plate part, and force will be applied to the movable plates through the plate part of the core when the core is turned. The locking crutch has a groove on each of two ends thereof to engage a corresponding said movable plate. The movable plates will be spring-biased towards the crutch embedding holes to engage the locking crutch as soon as the lock core is turned to the locking position; thus, the locking crutch and the body together form a loop. The movable plates will be forced to disengage from the locking crutch by the plate part of the lock core when the lock core is turned to the unlocking position.

Furthermore, several saw-resistant pins are inserted in receiving holes formed on a periphery of the lock body; thus, the lock is prevented from being damaged with a saw.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
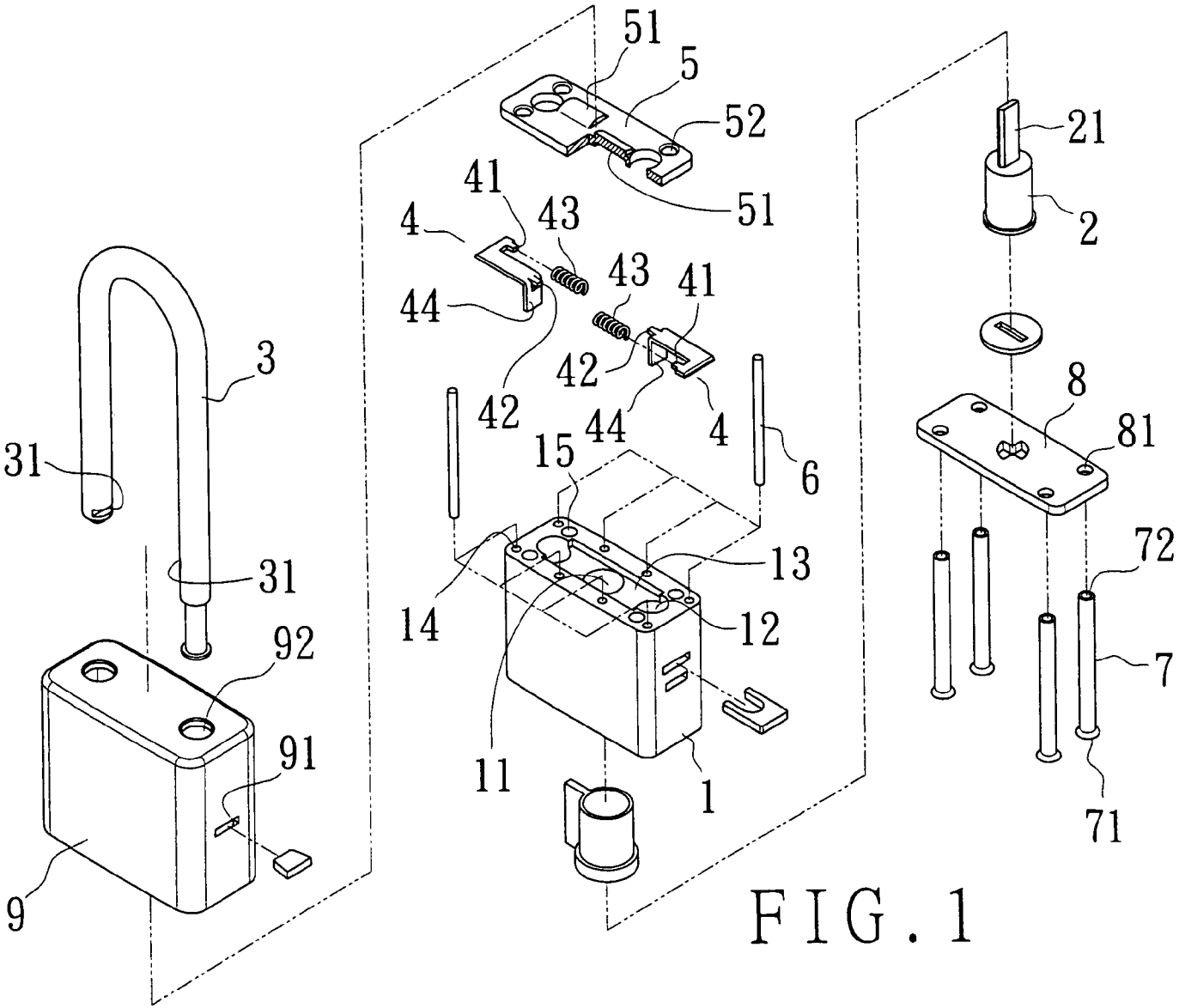
FIG. 1 is an exploded perspective view of the present invention.
Figure 3:
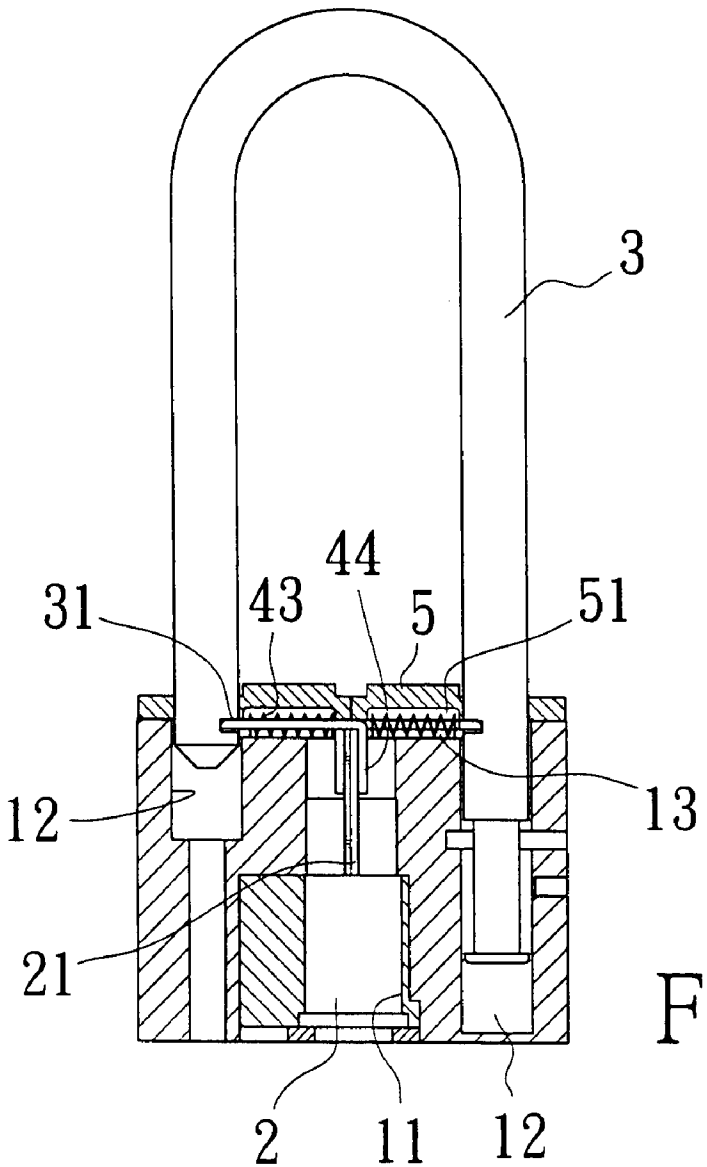
FIG. 3 is a sectional view of the present invention.
Figure 4:
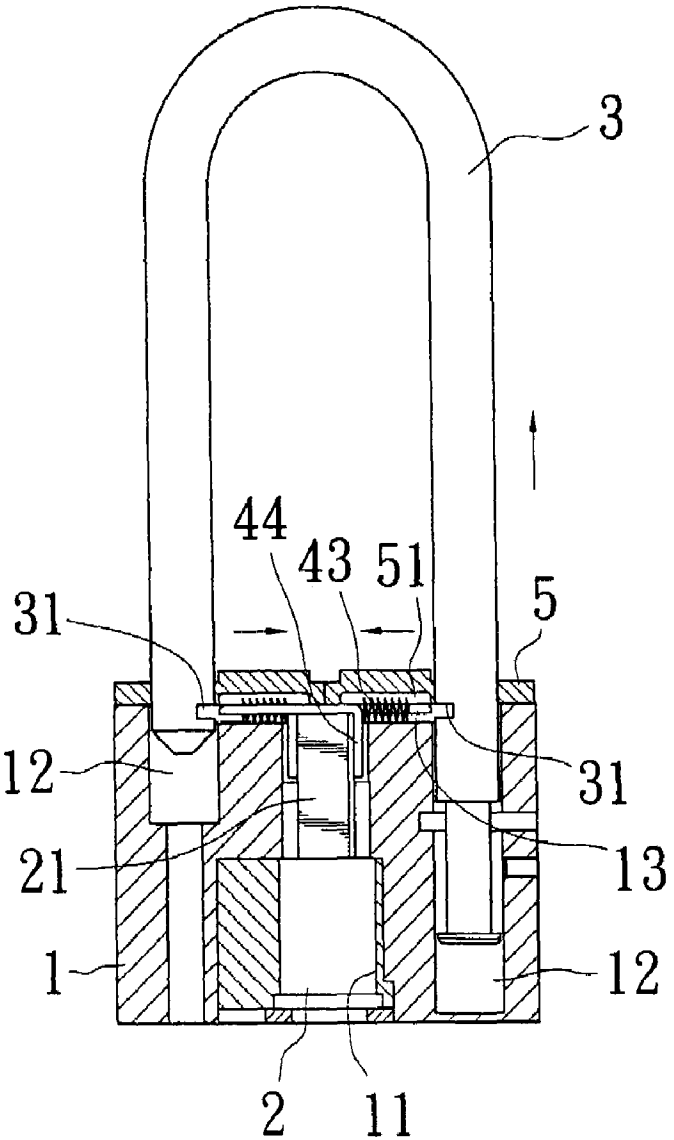
FIG. 4 is a sectional view of the lock of the present invention, taken when the lock is being moved to an opened configuration.
Figure 5:
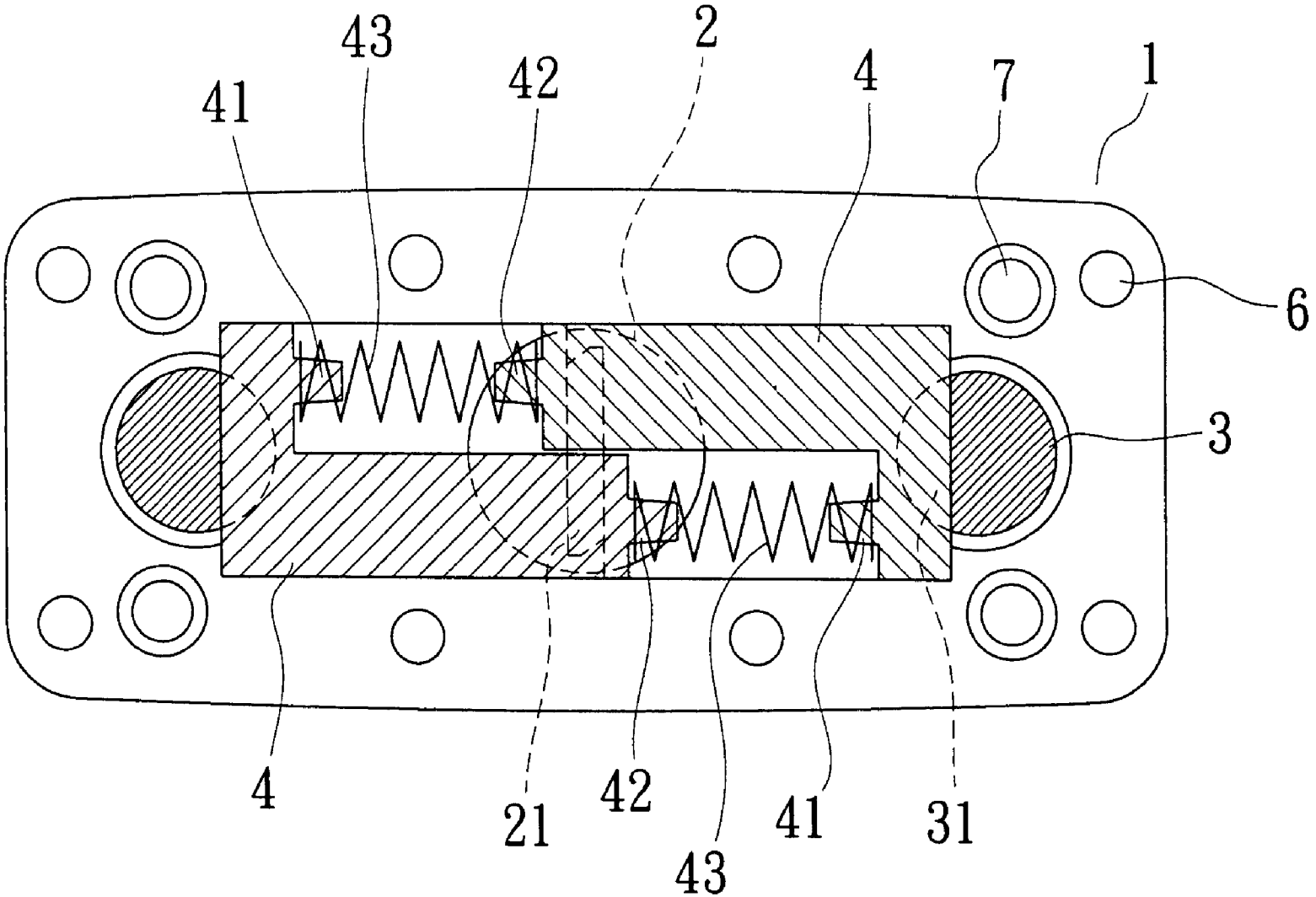
FIG. 5 is a horizontal sectional view of the present invention.
Figure 6:
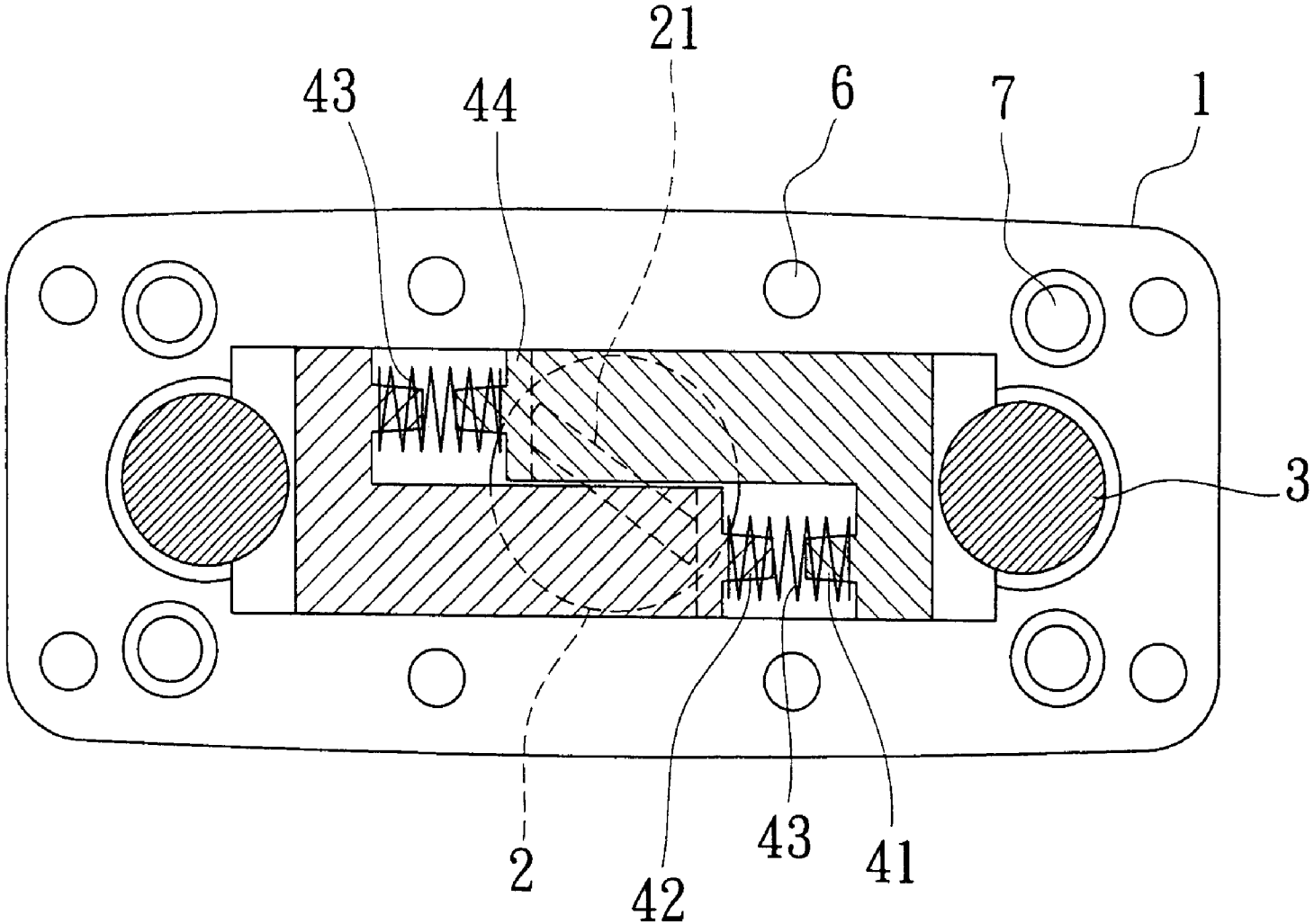
FIG. 6 is a horizontal sectional view of the present invention in the opened configuration.

Referring to FIG. 1, a preferred embodiment of a lock structure of the present invention includes:

a lock body 1; the lock body 1 has a lock hole 11 on a middle portion, and crutch embedding holes 12 on two sides of the lock hole 11; the lock body 1 further has a receiving recessed portion 13 on an upper side thereof, which adjoins upper ends of the lock hole 11 and the crutch embedding holes 12; the lock body 1 has several pin receiving holes 14 and fixing holes 15 on a periphery thereof;

a lock core 2 held in the lock hole 11 of the lock body 1; the lock core 2 has a plate part 21 at a front end thereof;

a locking crutch 3; the locking crutch 3 can be embedded in the crutch embedding holes 12 of the lock body 1 at two ends thereof; the two ends of the locking crutch 3 each have a groove 31 thereon, and both the grooves 31 are parallel to each other;

first and second movable plates 4, which are held in the receiving recessed portion 13 of the lock body, and biased towards the crutch embedding holes 12 of the lock body 1 with elastic elements 43 so that the crutch embedding holes 12 are normally partially covered with respective ones of the movable plates 4; each of the movable plates 4 has first and second joining protrusions 41 and 42; one of the elastic elements 43 is joined at two ends thereof on the first joining protrusion 41 of the first movable plate 4 and the second joining protrusion 42 of the second movable plate 4 while the other elastic element 43 is joined at two ends thereof on the second joining protrusion 42 of the first movable plate 4 and the first joining protrusion 41 of the second movable plate 4; furthermore, each of the movable plates 4 has a stopping plate part 44 to cooperate with the lock core 2;

an upper cover 5, which is secured on the upper side of the lock body 1 to cover the movable plates 4 and the elastic elements 43; the upper cover 5 has two receiving recessed portions 51 to receive the elastic elements 43 respectively; the upper cover 5 further has fixing holes 52, which are aligned with respective ones of the fixing holes 15 of the lock body 1;

several saw-resistant pins 6, which are inserted in the pin receiving holes 14 of the lock body 1 to prevent the lock from being damaged with a saw; the saw-resistant pins 6 have undergone heat treatment to increase their strength;

a bottom cover 8 secured on a bottom of the lock body 1 to cover the lock core 2; the bottom cover 8 has a keyway for a key to pass through, and several fixing holes 81;

several fixing pins 7, which are used to fasten the bottom cover 8, the lock body 1 and the upper cover 5 together; the fixing pins 7 have undergone heat treatment; the fixing pines 7 each have a truncated-cone shaped stopping portion 71 at a lower end, and a riveting hole 72 at an upper end; each of the fixing pins 7 is inserted in corresponding fixing holes 81, 15 and 52 in sequence so that the truncated-cone shaped stopping portion 71 contacts the bottom cover 8, and the riveting hole 72 sticks out from the fixing hole 52; the upper ends of the fixing pins 7 are hammered to closely come into contact with the upper cover 5; and a shell 9 positioned around the lock body 1; the shell 9 has a connecting hole 91, to which the lock body 1 is firmly connected; the shell 9 has two through holes 92, which face the crutch embedding holes 12 of the lock body 1 respectively to allow two ends of the locking crutch 3 to pass through, as shown in FIGS. 3 and 4.

In addition, the lock body 1 is a piece of hard plastic. The fixing holes 15 of the lock body 1 become gradually narrower towards one end, and have a smaller diameter than the fixing pins 7. And, the pin receiving holes 14 of the lock body 1 have a smaller diameter than the saw-resistant pins 6 so that the saw-resistant pins 6 can be closely in contact with the lock body 1.

Figure 2:
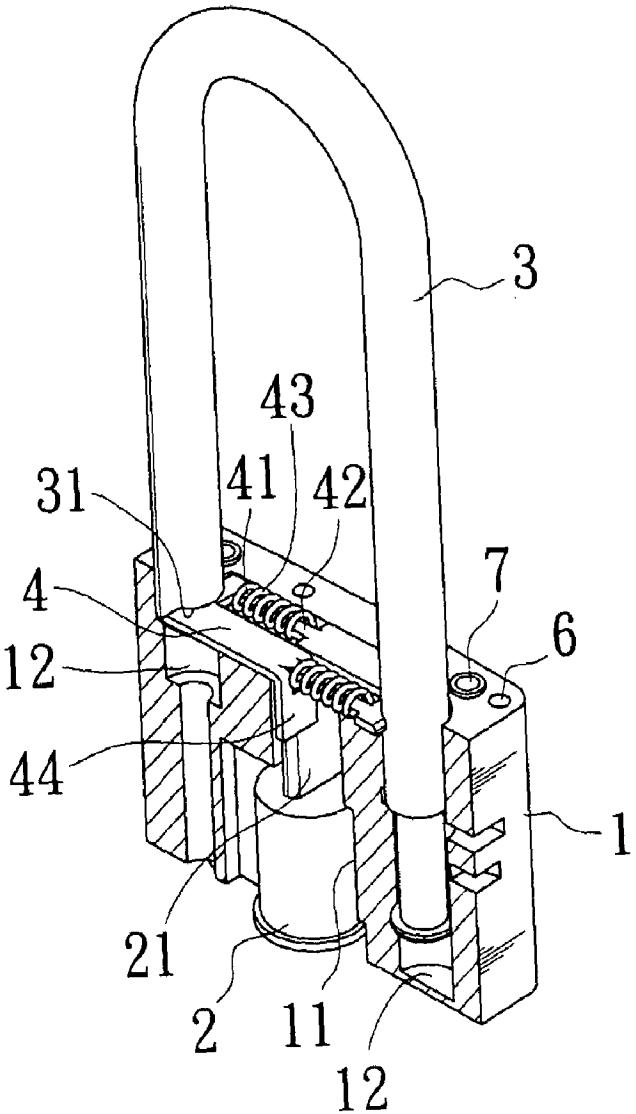
FIG. 2 is a perspective sectional view of the present invention.

Referring to FIGS. 1 and 2, in assembly, the lock core 2 is placed in the lock hole 11 of the lock body 1, with the plate part 21 being held in the upper section of the lock hole 11. And, the movable plates 4 are placed in the receiving recessed portion 13 of the lock body 1, and the elastic elements 43 are joined to the movable plates 4 so that the movable plates 4 are usually spring-biased towards corresponding said crutch embedding holes 12 so as to cover at least a portion of a corresponding said crutch embedding hole 12; thus, the movable plates 4 will be each detained in a corresponding said groove 31 of the locking crutch 3 if the locking crutch 3 is inserted in the crutch embedding holes 12 of the lock body 1. Therefore, the movable plates 4 will be forced to move away from the corresponding crutch embedding holes 12 by the plate part 21 of the lock core 2 if the lock core 2 is turned to an opening position, thus allowing the locking crutch 3 to move relative to the lock body 1 for the present lock to open. When the lock core 2 is turned to a locking position, the movable plates 4 will be forced to move onto corresponding said crutch embedding holes 12 by the elastic elements 43; thus, the movable plates can engage corresponding said locking crutch grooves 31 to prevent the locking crutch 3 from moving relative to the lock body 1, and in turn the lock is fixed in the locking configuration. Next, the upper cover 5 is positioned over the upper side of the lock body 1 to cover the movable plates 4 and the elastic elements 43, with the elastic elements 43 being held in the receiving recessed portions 51 of the upper cover 5. The bottom cover 8 is positioned under the bottom of the lock body 1, and the fixing pins 7 are passed through the fixing holes 81, 15 and 52 to fasten the bottom cover 8, the lock body 1, and the upper cover 5 together.

Referring to FIG. 3 to FIG. 6, as soon as the lock core 2 is turned to the opening position, the plate part 21 will push the stopping plate parts 44 of the movable plates 4 so that the elastic elements 43 are compressed, and the movable plates 4 disengage from the grooves 31 of the locking crutch 3. Consequently, the lock can be opened by means of moving the locking crutch 3 relative to the lock body 1. As soon as the lock core 2 is turned to the locking position, the elastic elements 43 will force the movable plates 4 to engage the grooves 31 of the locking crutch 3 again; thus, the lock body 1 and the locking crutch 3 together form a loop for allowing the present lock to be fixed in the locking configuration.

From the above description, it can be seen that the present invention has the following advantages:

1. The locking crutch has an engaging groove on each of two ends thereof, and the lock body of the present invention has two movable plates, which are held and capable of sliding in the upper receiving recessed portion of the lock body to engage the grooves of the locking crutch respectively. Therefore, the lock of the present invention can be more smoothly operated than conventional locks that have a locking crutch with single engaging groove.

2. For the above reason, the lock of the present invention can be more firmly fixed in the locking configuration.

3. The lock body of the present invention is protected against sawing by means of the saw-resistant pins, which are inserted in the periphery portion, and have already undergone heat treatment. Therefore, while having the same saw-resistant capability, the present lock body has relatively low manufacturing and assembling cost as compared with the prior art, which comprises several stacked metallic plates having already undergone heat treatment.

4. The fixing pins have also undergone heat treatment, and therefore can help prevent the lock from being damaged with a saw after they are joined to the bottom cover, the lock body and the upper cover.

What is claimed is:

1. A lock structure, comprising:

a lock body formed of a continuous unitary composition; the lock body having a lock hole on a middle portion; the lock body having crutch embedding holes on two sides of the lock hole thereof; the lock body having a receiving recessed portion at a first side thereof communicating with first ends of the lock hole and the crutch embedding holes;

a lock core held in the lock hole of the lock body; the lock core having a plate part at a first end thereof;

a locking crutch; the locking crutch including first and second ends to be inserted in the crutch embedding holes of the lock body respectively; each of the first and the second ends of the locking crutch having a groove thereon; the grooves being parallel to each other;

first and second movable plates held in the receiving recessed portion of the lock body; the movable plates remaining offset one from the other by a space, the movable plates being biased towards the crutch embedding holes of the lock body by elastic elements to at least partially cover the crutch embedding holes; each of the movable plates having first and second joining protrusions; the elastic elements traversing the space between the movable plates to be joined to respective joining protrusions thereof, the elastic elements each being thereby captured between the movable plates to bias the movable plates towards corresponding ones of said crutch embedding holes; each of the movable plates having a stopping plate part disposed for displacement responsive to force exerted through the lock core;

an upper cover secured on the first side of the lock body to cover the movable plates and the elastic; and a plurality of pin receiving holes formed through said lock body on a periphery thereof, and a plurality of saw-resistant pins being inserted in the pin receiving holes.

2. The lock structure as claimed in claim 1, wherein the upper cover has at least one recessed portion facing the elastic elements.

3. The lock structure as claimed in claim 1 further having a bottom cover secured on a bottom of the lock body to cover the lock core; the bottom cover having a keyway for a key to pass through.

4. The lock structure as claimed in claim 3, wherein the lock body has a plurality of fixing holes on a periphery thereof, and the upper cover and the bottom cover each have a plurality of fixing holes facing the fixing holes of the lock body respectively, and a plurality of fixing pins are inserted in the fixing holes to fasten the lock body, the upper cover, and the bottom cover together.

5. The lock structure as claimed in claim 4, wherein each of the fixing pins has a truncated-cone shaped stopping portion at one end, and a riveting hole at an opposite end thereof.

6. The lock structure as claimed in claim 4, wherein the fixing pins have already undergone heat treatment.

7. The lock structure as claimed in claim 5, wherein the fixing pins have already undergone heat treatment.

8. The lock structure as claimed in claim 1 further comprising a shell; the shell having a connecting hole, the lock body being secured to the shell therethrough.

9. The lock structure as claimed in claim 1, wherein the saw-resistant pins have already undergone heat treatment

10. The lock structure as claimed in claim 1, wherein the lock body is formed of hard plastic.

* * * * *